US005629612A

United States Patent [19]

Schaffer

[11] Patent Number: 5,629,612

[45] Date of Patent: May 13, 1997

[54] METHODS AND APPARATUS FOR IMPROVING TEMPERATURE DRIFT OF REFERENCES

[75] Inventor: Gregory L. Schaffer, Cupertino, Calif.

[73] Assignee: Maxim Integrated Products, Inc., Sunnyvale, Calif.

[21] Appl. No.: 614,195

[22] Filed: Mar. 12, 1996

[51] Int. Cl.[6] ..... G05F 3/16

[52] U.S. Cl. ..... 323/313; 323/907

[58] Field of Search ..... 323/313, 314, 323/315, 316, 907; 327/534, 535, 538, 539, 540

[56] References Cited

U.S. PATENT DOCUMENTS

| | | | |
|---|---|---|---|
| 4,176,308 | 11/1979 | Dobkin et al. | 323/313 |
| 4,249,122 | 2/1981 | Widlar | 323/313 |
| 4,277,739 | 7/1981 | Priel | 323/313 |
| 4,447,784 | 5/1984 | Dobkin | 323/313 |
| 4,769,589 | 9/1988 | Rosenthal | 323/313 |
| 5,148,099 | 9/1992 | Ong | 323/907 |
| 5,220,273 | 6/1993 | Mao | 323/313 |
| 5,373,226 | 12/1994 | Kimura | 323/313 |

*Primary Examiner*—Matthew V. Nguyen
*Attorney, Agent, or Firm*—Blakely, Sokoloff, Taylor & Zafman LLP

[57] ABSTRACT

Methods and apparatus for improving the temperature drift of references by providing temperature compensation trimmable after packaging of the integrated circuit. In accordance with the method, first, second and third trim parameters are generated and trimmed at wafer sort so that the first parameter is substantially independent of temperature, and at a nominal temperature, the second and third parameters are zero, with the second being proportional to the temperature rise above nominal and the third being proportional to temperature decrease below nominal. After packaging, a component of the first parameter is combined with the output of the reference to obtain the desired output at the nominal temperature, after which a component of the second parameter is combined with the output of the reference to obtain the desired output at a temperature above the nominal temperature, and a component of the third parameter is combined with the output of the reference to obtain the desired output at a temperature below the nominal temperature. The compensation is made permanent by blowing fuses. Various embodiments are disclosed.

32 Claims, 8 Drawing Sheets

METHODS AND APPARATUS FOR IMPROVING TEMPERATURE DRIFT OF REFERENCES

BACKGROUND OF THE INVENTION

1. Field of the Invention

The present invention relates to the field of integrated circuits, and more particularly to temperature stabilization of circuits providing some form of reference to other circuits.

2. Prior Art

In many systems, it is required to generate one or more references which maintain predetermined accurate values, system to system and over the desired operating temperature range of the system. In many applications, it is desired to generate the reference on an integrated circuit for use by other circuits on the same chip. In other applications, it is desired to generate the reference on an integrated circuit for use by other integrated circuits, or alternatively, for use by other integrated circuits and also for use by other circuits on the same chip as the circuit generating the reference. Such references include, but are not necessarily limited to, voltage references, current references and frequency references.

The preferred embodiment of the present invention described herein relates specifically to voltage references. In general, it is difficult to make high precision voltage references since these require a tight tolerance on the reference voltage and a low drift with temperature. Normally, to achieve better precision, the room temperature reference voltage is trimmed at wafer sort. This can be easily done to ±0.1% of the nominal desired voltage. But after packaging, the reference voltage can shift. This shift is a function of process, layout and packaging (and probably some other factors). To achieve accuracy better than around ±0.5%, one usually needs some form of post-package trim. This adjusts the reference voltage to the nominal value at room temperature; however, it doesn't guarantee low temperature drift.

One very commonly used voltage reference is the bandgap reference. This type of reference combines two components of voltage, one of a positive temperature coefficient and one of a negative temperature coefficient, to achieve a combined voltage reasonably temperature insensitive. In particular, the base-emitter voltage of a junction transistor is given by the following equation:

$$V_{BE} = V_{go}\left(1-\frac{T}{T_0}\right) + V_{BE0}\left(\frac{T}{T_0}\right) + \frac{nKT}{q}\ln\left(\frac{T_0}{T}\right) + \frac{KT}{q}\ln\left(\frac{I_C}{I_{C0}}\right)$$

where:

T=temperature $T_0$=an arbitrary reference or starting temperature $I_C$=the transistor collector current $I_{C0}$=collector current for which $V_{BE0}$ was determined $V_{go}$=semiconductor bandgap voltage extrapolated to a temperature of absolute zero $V_{BE0}$=base to emitter voltage V at $T_0$ and $I_{C0}$ q=electron charge n=structure factor K=Boltzmann's constant The dominant terms are the first two terms:

$$V_{go}\left(1-\frac{T}{T_0}\right) + V_{BE0}\left(\frac{T}{T_0}\right) = V_{go} - (V_{go} - V_{BE0})\left(\frac{T}{T_0}\right)$$

and since $V_{go}$ is larger than $V_{BE0}$, the net result is a negative temperature coefficient.

If one subtracts the VBEs of two identical transistors $Q_1$ and $Q_2$ operating with different collector currents, there results:

$$V_{BE1} - V_{BE2} = \frac{KT}{q}\ln\left(\frac{I_{C1}}{I_{C0}}\right) - \frac{KT}{q}\ln\left(\frac{I_{C2}}{I_{C0}}\right)$$

or:

$$V_{BE1} - V_{BE2} = \frac{KT}{q}\ln\left(\frac{I_{C1}}{I_{C2}}\right)$$

This usually is expressed in terms of current densities $J_1$ and $J_2$ in the two transistors as follows:

$$V_{BE1} - V_{BE2} = \frac{KT}{q}\ln\left(\frac{J_1}{J_2}\right)$$

A bandgap reference takes advantage of these two components by adding a $V_{BE}$ (or a forward biased diode voltage drop) to a properly weighted $V_{BE}$ difference of two transistors operating at different current densities.

The temperature drift of bandgap references is a strong function of the reference voltage. Minimal temperature drift usually occurs around a bandgap voltage of 1.23 V. A 1% change in this reference voltage can easily shift the temperature drift by 30 ppm/°C. Even if the reference voltage is trimmed to the ideal value, there is variability due to process, device matching, circuit design, and (possibly) packaging effects.

The result is that it's difficult to make precision references (<±0.1% initial accuracy, <±10 ppm/°C.) without very careful trimming, etc. Even if the tolerance is tight and average drift is low, references tend to have nonlinear temperature drift (curvature) that constitutes a major error.

BRIEF SUMMARY OF THE INVENTION

Methods and apparatus for improving the temperature drift of references by providing temperature compensation trimmable after packaging of the integrated circuit are disclosed. In accordance with the method, first, second and third trim parameters are generated and trimmed at wafer sort so that the first parameter is substantially independent of temperature, and at a nominal temperature, the second and third parameters are zero, with the second being proportional to the temperature rise above nominal and the third being proportional to temperature decrease below nominal.

After packaging, a component of the first parameter is combined with the output of the reference to obtain the desired output at the nominal temperature, after which a component of the second parameter is combined with the output of the reference to obtain the desired output at a temperature above the nominal temperature and a component of the third parameter is combined with the output of the reference to obtain the desired output at a temperature below the nominal temperature. The compensation is made permanent by such means as blowing fuses.

Various embodiments are disclosed.

DETAILED DESCRIPTION OF THE INVENTION

The preferred embodiment of the present invention is used as a post packaging trim of bandgap references to adjust both the nominal room temperature output of the references and to reduce the temperature sensitivity of such references. In the preferred embodiment, a post-package trim is made at three temperatures: room, hot and cold. In effect, three trims are made: 1) an offset adjustment to give the nominal reference voltage at room temperature, $T_{NOM}$; 2) a temperature coefficient adjustment fortemperatures greater than $T_{NOM}$; and 3) a temperature coefficient adjustment for temperatures lower than $T_{NOM}$. Then an error correction voltage increment $V_{err}$ is determined to provide a piecewise linear temperature sensitivity correction:

$$V_{err}=V_{os}+K_H*(T-T_{NOM}) \text{ for } T\geqq T_{NOM}$$

$$V_{err}=V_{os}+K_C*(T_{NOM}-T) \text{ for } T\leqq T_{NOM}$$

where:

$V_{os}$ is the room temperature offset adjust $K_H$ is the adjustable temperature coefficient for $T>T_{NOM}$ $K_C$ is the adjustable temperature coefficient for $T<T_{NOM}$ $K_H$ and $K_C$ (units are in mV/°C.) can be either positive or negative.

Figure 1:
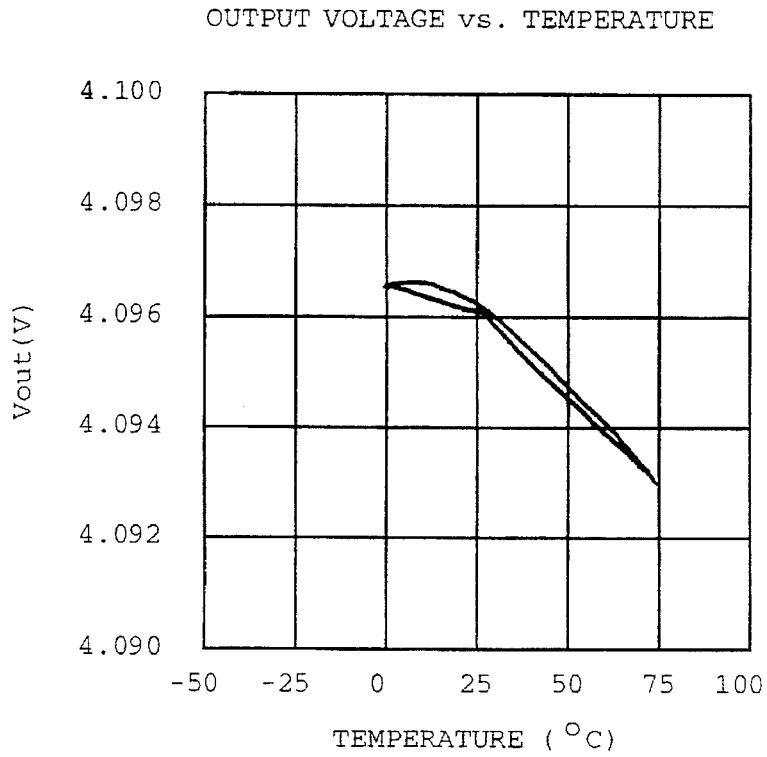
FIG. 1 illustrates the typical temperature drift characteristics of the MAX 874 10 μA, Low-Dropout, Precision Voltage Reference manufactured by Maxim Integrated Products and correction signals for a commercial temperature range of 0° to 70° C.

To illustrate the improvement in performance achievable, consider the temperature drift of a MAX 874 10 μA, Low-Dropout, Precision Voltage Reference manufactured by Maxim Integrated Products, assignee of the present invention. FIG. 1 illustrates the typical temperature drift characteristics of the MAX 874. FIG. 1 also shows the 25° C. output of the reference $V_{out}$ to be at the nominal 4.096 volts, when in practice typical units after packaging will vary within a range of variance centered at or close to 4.096 volts.

Figure 2:
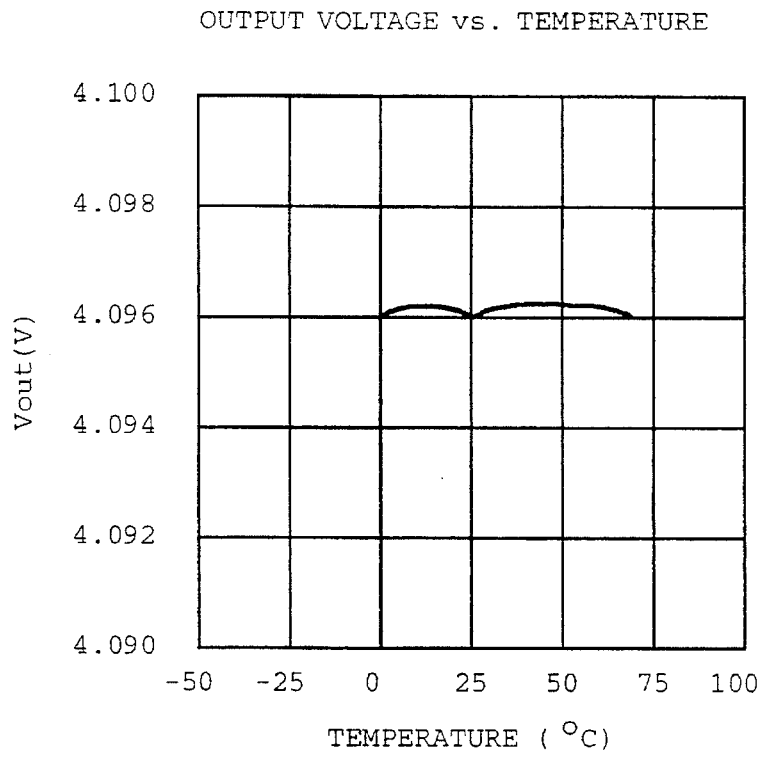
FIG. 2 illustrates the typical temperature drift characteristics of the MAX 874 10 μA, Low-Dropout, Precision Voltage Reference using the present invention post-package trim scheme to improve drift over a commercial temperature range of 0° to 70° C.

If the present invention post-package trim scheme is used to improve drift over a commercial temperature range of 0° to 70° C., the final drift, shown in FIG. 2, is about $1/15^{th}$ of the original error. (This trim includes the trim of any deviation from 4.096 volts at 25° C., though none is shown in FIG. 1.) This drift, corresponding to the deviation of the actual temperature drift curve from the linear piece-wise approximation thereof shown in FIG. 1, corresponds to an error of 300 μV or less from 0° C. to +70° C. Note that for a 4.096 V reference, 1 mV corresponds to 1 LSB (least significant bit) for a 12 bit A/D converter, so 0.3 mV gives 3/10 LSB over this range. This sort of error is equivalent to a drift specification of about 2 ppm/°C.

Figure 3:
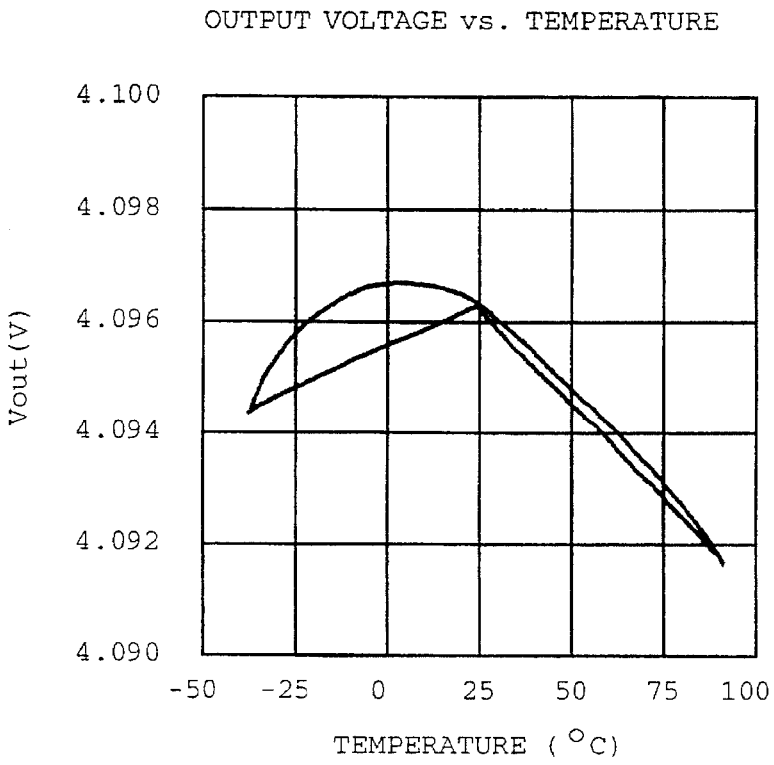
FIG. 3 illustrates the typical temperature drift characteristics of the MAX 874 10 μA, Low-Dropout, Precision Voltage Reference and correction signals for an extended temperature range of –40° C. to 85° C.
Figure 4:
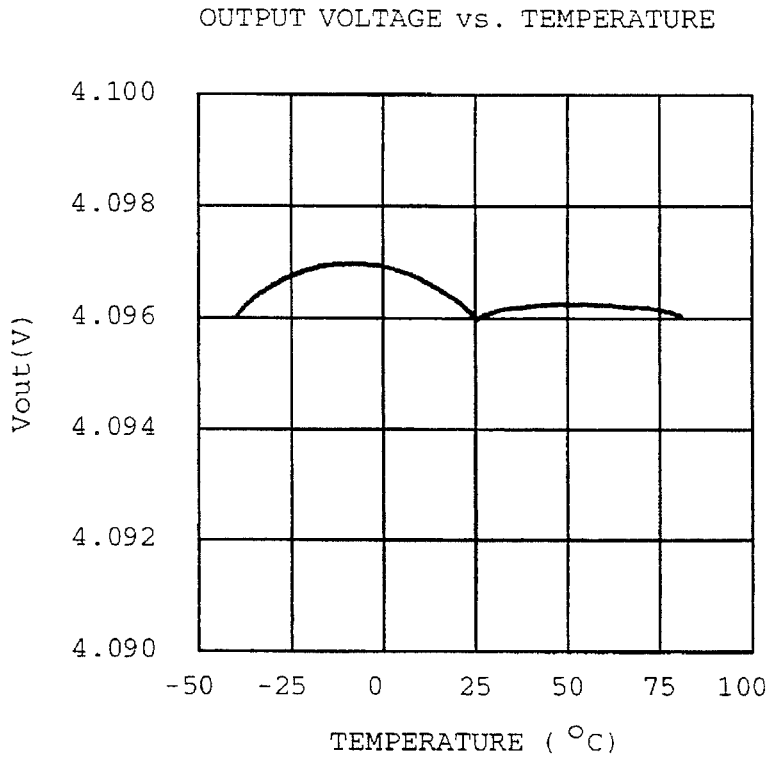
FIG. 4 illustrates the typical temperature drift characteristics of the MAX 874 10 μA, Low-Dropout, Precision Voltage Reference using the present invention post-package trim scheme to improve drift over the extended temperature range of –40° C. to 85° C.

Shown in FIG. 3 are the correction signals for the extended temperature range of –40° C. to 85° C. Because of the large amount of curvature from 0° C. to –40° C., one gets a fairly large maximum error (≈1.3 mV) after using the present invention post-packaging trim scheme, as shown in FIG. 4. However this still gives about 5 ppm/°C. in this region ((1.3 mV/4.096 V)/65° C.).

Dramatic improvements can be made using the present invention with simple bandgap references. By way of example, the MAX 921–924 family of Ultra Low-Power Comparators uses a PTAT (proportional to absolute temperature) current source driving a resistor in series with a diode. The resulting performance is ≈50 ppm/°C. Using the proposed post-package trimming scheme, it is anticipated that all 10 of these units can have their drift reduced to ≦1 mV over the temperature range –25° C. to +85° C. (industrial range). This suggests that the parts could meet a 0.2% spec over this range. If a more accurate bandgap reference is built (with curvature correction), it should be possible to get high yield to 10 ppm/°C. drift specs.

In order to implement the post-package trim scheme of the preferred embodiment, three current sources are need:

$$\begin{aligned} I_O &= \text{a "constant" current source} \\ I_H &= C_H*(T-T_{NOM}) \text{ for } T\geqq T_{NOM} \\ &= 0 \text{ for } T<T_{NOM} \\ I_C &= C_C*(T_{NOM}-T) \text{ for } T\leqq T_{NOM} \\ &= 0 \text{ for } T>T_{NOM} \end{aligned}$$

The constant current source is derived from the current flowing through a resistor with $V_{BG}$ (the bandgap voltage) across the resistor. $I_H$ (hot) and $I_C$ (cold) come from the difference between $I_O$ and a PTAT (proportional to absolute temperature) current source. These currents will exhibit a small deviation from their desired temperature sensitivity, some or most of which will be nonlinear. However, as shall be shown, these current sources are used to make small error corrections in the bandgap source to be temperature compensated, so that the small deviation of a small correction becomes negligible in the end result.

Figure 5:
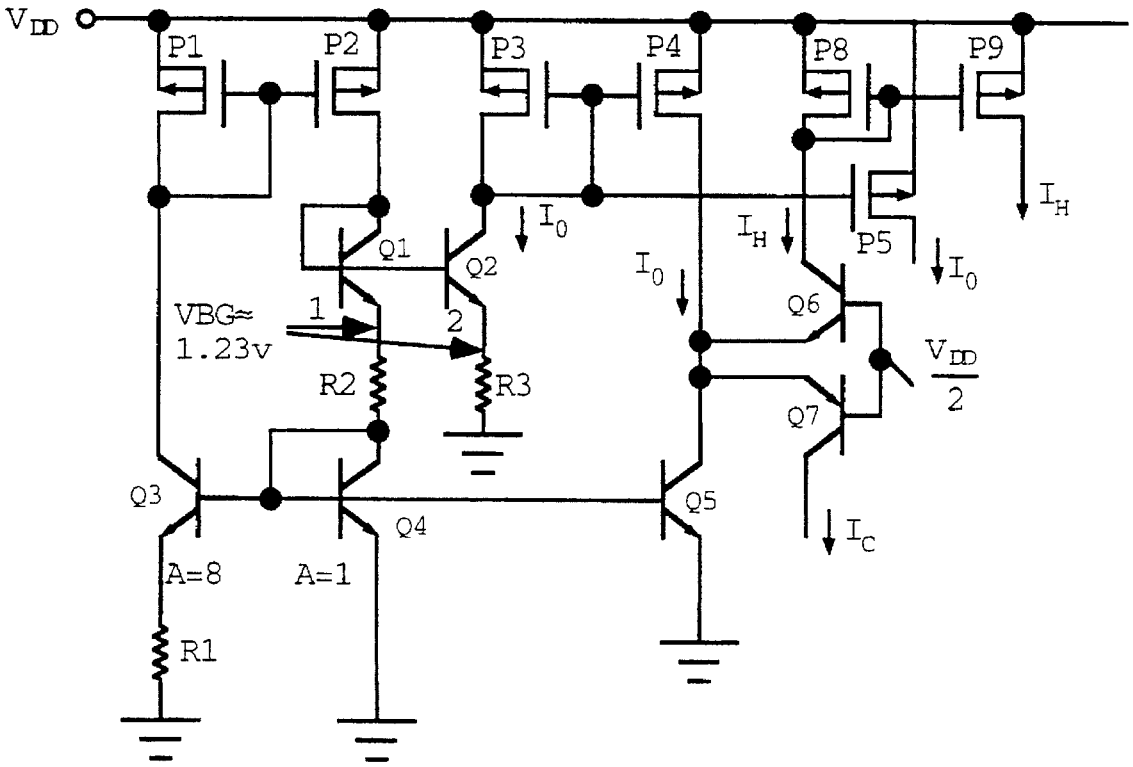
FIG. 5 is a circuit diagram for generating the three compensating current sources $I_O$, $I_H$ and $I_C$.

A circuit that provides all three current sources is shown in FIG. 5. In this circuit, resistors R1, R2 and R3 are thin film (temperature independent) resistors. Transistors P1 and P2 are connected as a current mirror, so that the current through transistors P1 and Q3 is mirrored to transistors P2, Q1 and Q4. Transistor Q3 is eight times larger than Q4, so that transistor Q4 operates at eight times the current density of transistor Q3. The actual current level is set by resistor R1 as:

$$I_{Q3} = \frac{(V_{BEQ4} - V_{BEQ3})}{R_1} = \frac{KT}{qR_1} \ln \frac{J_4}{J_3}$$

The voltage $V_{BE}$ across diode connected transistor $Q_4$ provides a negative temperature coefficient dependence (see the discussion in the prior art section), with the voltage across resistor $R2=I_2R_2$ providing an appropriate positive temperature coefficient component to yield the substantially temperature independent bandgap voltage $V_{BG}$ at node 1. This constant voltage is mirrored by transistors Q1 and Q2 to resistor R3, which sets a constant current $I_0$ through transistors P3 and Q2. Transistor P3 mirrors the current $I_0$ to transistor P5 to provide the temperature insensitive trim current $I_0$, and also mirrors the current $I_0$ to transistor P4.

Transistors Q6 and Q7 have their bases coupled together and to an intermediate voltage VDD/2, and their emitters connected to the drain of transistor P4 and the collector of transistor Q5. To the extent that the positive temperature coefficient current $I_{PTAT}$ through transistor Q5, as mirrored from transistor Q4, equals the temperature independent current $I_0$ through transistor P4 at $T_{NOM}$, transistors Q6 and Q7 will both be off and the current components $I_H$ and $I_C$ will both be zero. At temperatures above this condition, the positive temperature coefficient current in transistor Q5 will increase so as to exceed the current $I_0$, pulling the voltage of the emitter of transistor Q6 down to turn the same on, so that $I_H+I_0=I_{PTAT}$. Thus, $I_H$ starts from a zero value at the temperature at which $I_{PTAT}$ equals $I_0$, and increases therefrom with increasing temperature at a rate proportional to the increase in temperature over the temperature at which $I_0$ equaled $I_{PTAT}$. During this time, transistor Q7 is off and $I_C$ is zero. Similarly, when the temperature decreases from the temperature at which $I_0$ equals $I_{PTAT}$, the magnitude of $I_{PTAT}$ will decrease below $I_0$. Thus, $I_0$ will pull the emitter of transistor Q7 higher to turn the same on so that $I_C$ equals $I_0-I_{PTAT}$, transistor Q6 now being turned off and $I_H$ remaining at zero. Thus, for temperatures below the temperature at which $I_0$ equals $I_{PTAT}$, a current $I_C$ will be provided having a magnitude proportional to how much lower the temperature is than the temperature for which $I_0$ equals $I_{PTAT}$. Transistors P8 and P9, connected as a current mirror, mirror the current to provide an $I_H$ source.

Accordingly, a first output current $I_0$ is provided which is substantially independent of temperature. At some nominal temperature, typically selected to be room temperature for convenience, $I_0$ will equal $I_{PTAT}$ so that $I_H$ and $I_C$ are both zero. To achieve this, resistors R1 and R2 may be trimmed at the time of wafer sort. An increase in the resistance of resistor R2 will increase the voltage on node 1 as a result of the higher voltage drop across resistor R2 from the current flowing there through. An increase in the resistance of resistor R1, on the other hand, decreases the current through transistors Q3 and P1, reducing the current mirrored to transistor P2 flowing through resistor R2 to reduce the voltage on node 1, allowing adjustment of the voltage on node 1 at wafer sort up or down to reach the desired bandgap voltage. Trimming of resistor R3 at wafer sort allows the reduction of the constant current $I_0$, nominally designed to be somewhat high at room temperature, to equal $I_{PTAT}$ at room temperature (or any other "nominal" temperature selected).

Figure 6:
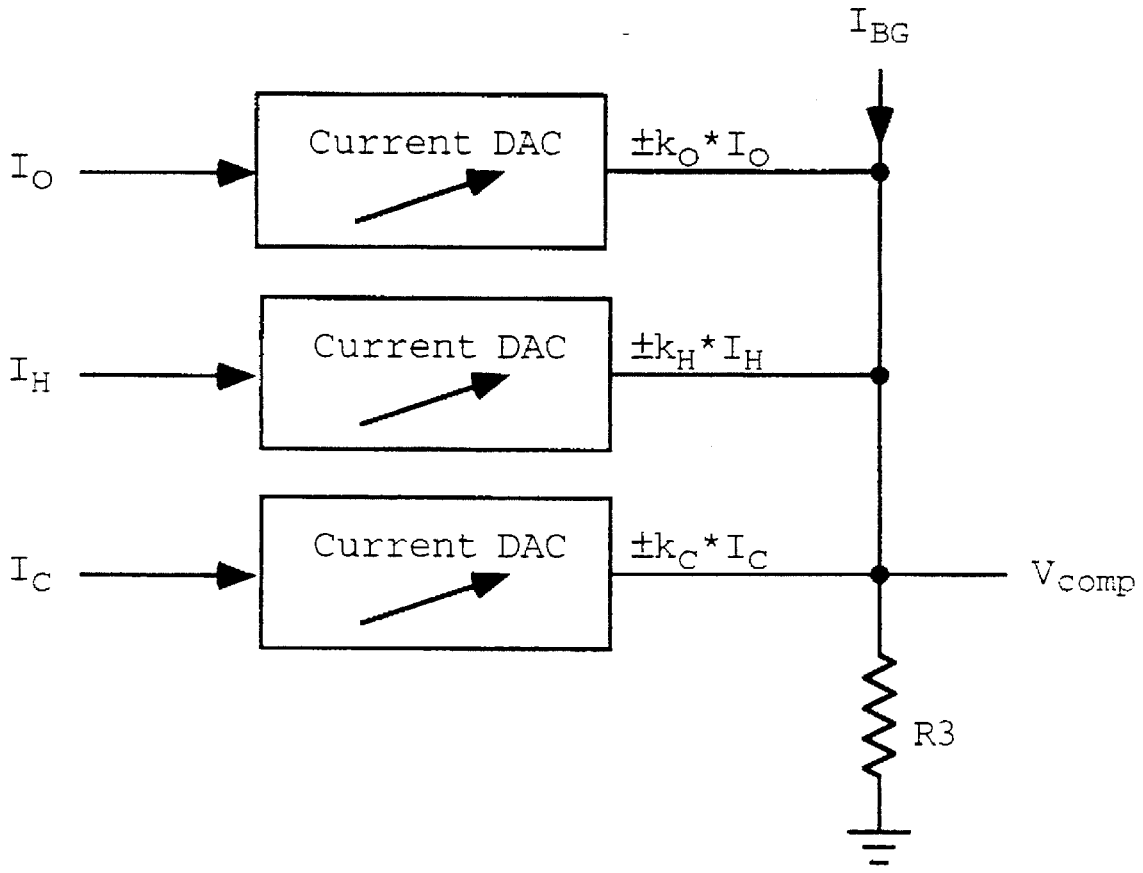
FIG. 6 is a block diagram illustrating three programmable current DACs to generate the error corrections based on $I_O$, $I_H$ and $I_C$.

The three currents $I_O$, $I_H$ and $I_C$ can be fed to three programmable current DACs to generate the required error correction voltage, as shown in FIG. 6. In a preferred embodiment, the DACs each respond to a digital input, such as a six bit trim signal, and for each of 5 bits, generate a corresponding current component of, or proportional to, the respective current $I_0$, $I_H$ and $I_C$ weighted in a binary progression in accordance with the respective bit position. This provides a selection of correction currents in a binary progression, which can be made permanent by blowing fuses or programming other, non-volatile storage devices.

DACs of this type are well known in the prior art and, accordingly, the details thereof need not be provided herein. Also, on the assumption that corrective components of either sign may be required, each DAC in this exemplary embodiment would include incremental current sourcing and current sinking capability to the node $V_{COMP}$ by either steering a respective component of compensating current from the positive power supply into the node, or alternatively, sinking a current from the node to ground, depending upon the respective bit in the digital compensation signal. In that regard, in any particular instance only a positive or a negative compensating signal is required, not both at the same time, so that the sixth bit of the multi-bit compensating signals may be used for selection of the sign of the correction.

In FIG. 6, positive and negative temperature correction capabilities are shown for both the corrective current components $I_C$ and $I_H$. In many applications, both positive and negative correction capabilities will not be required, as frequently the variation of the reference with temperature is a predictable residual left over from whatever compensation is included in the basic circuit. See, for instance, FIGS. 1 and 3 for the MAX 874 10 μA, Low-Dropout, Precision Voltage Reference previously discussed. For the correction of the nominal setting, obviously one could set the output on one side of the desired nominal output at the time of wafer sort so that the sign of the correction required to achieve the nominal output voltage at the selected reference temperature would also be known ahead of time. This, however, in general is not preferred, as it substantially increases the average correction required and in many instances care will have been taken to provide greater stability in the circuit being compensated than in the compensation circuit itself. However, the sign of the $I_C$ and $I_H$ correction components can be predicted in many instances, so that only one polarity of each set of correction components will need to be provided.

The actual implementation one would use may depend on the bandgap reference itself, as various known reference circuits include additional circuitry for compensation with which the present invention may be adapted to interface. As a specific example, note that in the circuit of FIG. 5, the bandgap voltage appears at node 1, and across resistor R3 at node 2. Thus appropriate correction currents $I_0$, $I_H$ and $I_C$ into and/or out of node 1 will correct the room temperature error and most of the hot and cold drift in the bandgap voltage. Also note that if a different bandgap reference circuit is used, then that circuit may well have a constant current and/or an $I_{PTAT}$ component of current that can be easily mirrored for use in the correction circuit, negating the need for much of the circuitry of FIG. 5.

The actual trim procedure may use an internal counter that drives the DACs, as subsequently described. Each DAC would have a fuse for each digit and a master fuse that, once blown, prevents the DAC's (programmed) code from being altered again.

Thus, a typical trim procedure would be as follows:

1. Measure the output voltage of the reference $V_{REF}$ at $T_{NOM}$ (probably +25° C., preferably as close to the same temperature as used for trimming at wafer sort as conveniently possible) and program the $I_O$ DAC to get $V_{REF}=V_{NOM}$, the desired reference voltage. Then blow the fuses for this DAC.
2. Go to the hot temperature and select the $I_H$ DAC. Program it to get $V_{REF}=V_{NOM}$ at this temperature. Then blow the fuses for this DAC.
3. Go to the cold temperature, select the $I_C$ DAC and program it to get $V_{REF}=V_{NOM}$. Then blow the fuses for this DAC.

Of course, one typically would also test the other specs of the reference at these three temperatures. Thus one not only gets a calibrated reference, but also one that's been tested at three temperatures. Also, while step 1 above is generally done first, either step 2 or step 3 may be done before the other, and no particular order in this regard is to be implied in this disclosure or the claims that follow.

If further piece-wise linear compensation is needed or desired, one or more additional compensating current components may be generated based on other "nominal" temperatures. By way of example, much of the basic circuit of FIG. 5 could be replicated two times, with the basic circuit being trimmed at wafer sort so that $I_{PTAT}=I_0$ at 25° C., the first replication trimmed at wafer sort so that $I_{PTAT}=I_0$ at 75° C. and the second replication trimmed at wafer sort so that $I_{PTAT}=I_0$ at −10° C. Only the $I_H$ component of the first replication and the $I_C$ component of the second replication would be generated and used. This provides five distinct points at which the nominal output of the reference may be uniquely and independently adjusted:

1. At 25° C. to set the temperature insensitive adjustment of the basic circuit
2. Then at 75° C. and −10° C. to set $I_H$ and $I_C$ respectively of the basic circuit
3. Then at still higher and lower temperatures, such as 125° C. and −55° C. to set $I_H$ and $I_C$ for the second and third replications of the basic circuit, respectively.

Note also that in some instances, references are to be trimmed so as to always be within as narrow a ± range around the nominal reference output as possible, in which case the best compensation setting at each of the compensation setting temperatures may be something predictably slightly different than directly at the nominal reference output.

In the previously described embodiments, temperature compensation was achieved by providing one or more temperature correction components which varied linearly with temperature above one or more nominal temperatures and were zero otherwise, and/or which varied linearly with temperature below one or more nominal temperatures and were otherwise zero. However, there may be other variations with temperature which will more accurately compensate for the temperature variation in the reference output. By way of specific example, one might consider a square law or quadratic compensation, given the output voltage temperature variation of the bandgap reference of FIGS. 1 and 3.

Figure 7:
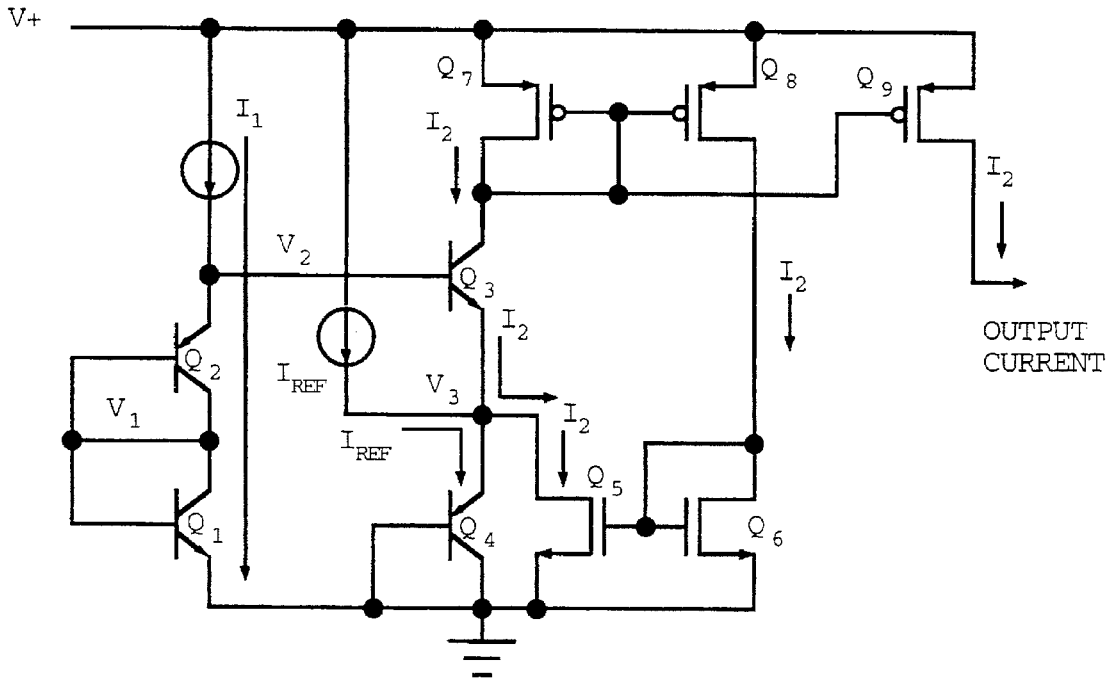
FIG. 7 is a circuit diagram for generating three compensating current sources $I_{Osq}$, $I_{Hsq}$ and $I_{Csq}$ having a square law current variation with temperature.

Such a square law current variation with temperature may be provided by the circuit of FIG. 7. In this Figure, $I_{REF}$ would typically be a substantially constant current, and could be a current mirrored from the substantially temperature independent current $I_0$ of FIG. 5. The current source $I_1$, on the other hand, would typically be a current having a known and desired temperature sensitivity. More particularly, in the present invention, $I_1$ could be proportional to $I_H$, or alternatively, to $I_C$. Additionally, two separate square law circuits could be used, one for hot ($I_1=I_H$) and one for cold ($I_1=I_C$).

Assume transistors $Q_1$ and $Q_3$ match, and transistors $Q_2$ and $Q_4$ match. Also of course, all transistors are at the same temperature, the circuit being realized in integrated circuit form. In this circuit, transistor $Q_7$ mirrors the current in transistor $Q_3$ to transistor $Q_8$, with transistor $Q_6$ mirroring the same back to transistor $Q_5$ so that the current in transistor $Q_3$ does not go into the emitter of transistor $Q_4$. Thus:

$$V_1 = V_T \ln \frac{I_1}{I_{SNPN}} + f_1(T) = (V_{BE})_{Q1}$$

where $V_T$=KT/q and $f_1(T)$=other temperature dependent terms (see the full equation for $V_{BE}$ in the prior art section)

$$V_2 - V_1 = V_T \ln \frac{I_1}{I_{SPNP}} + f_2(T) = (V_{BE})_{Q2}$$

$$V_2 = V_T \left( \ln \frac{I_1}{I_{SNPN}} + \ln \frac{I_1}{I_{SPNP}} \right) + f_1(T) + f_2(T)$$

also:

$$V_3 = V_T \ln \frac{I_{REF}}{I_{SPNP}} + f_2(T) = (V_{BE})_{Q4}$$

($Q_2$ and $Q_4$ matched)

$$V_2 - V_3 = V_T \ln \frac{I_2}{I_{SNPN}} + f_1(T) = (V_{BE})_{Q3}$$

($Q_1$ and $Q_3$ matched)

$$V_2 = V_T \left( \ln \frac{I_{REF}}{I_{SPNP}} + \ln \frac{I_2}{I_{SNPN}} \right) + f_1(T) + f_2(T)$$

Therefore, using the two equations for $V_2$:

$$\ln \left( \frac{I_1^2}{I_{SNPN} I_{SPNP}} \right) = \ln \left( \frac{I_{REF} I_2}{I_{SPNP} I_{SNPN}} \right)$$

$$\text{or } I_1^2 = I_{REF} I_2$$

$$\rightarrow I_2 = \frac{I_1^2}{I_{REF}}$$

Consequently if $I_1$ is $I_H$, then:

$$V_{err}=V_{os}+K_{Hsq}*(T-T_{NOM})^2 \text{ for } T \geqq T_{NOM}$$

and if $I_1=I_C$, then:

$$V_{err}=V_{os}+K_{Csq}*(T_{NOM}-T)^2 \text{ for } T \leqq T_{NOM}$$

where:

$V_{os}$=room temperature offset adjust $K_{Hsq}$=adjustable temperature coefficient for $T>T_{NOM}$ $K_{Csq}$=adjustable temperature coefficient for $T<T_{NOM}$ Other temperature difference dependencies may be easily generated as desired. Finally, the temperature difference dependence above the nominal temperature may be purposely made to be different from that below the nominal temperature if desired to better match the temperature compensation needed.

Referring again to FIG. 1 and particularly FIG. 3, it will be noted that for this device, the remaining temperature sensitivities are nonlinear with temperature, and can be approximated on each side of the nominal temperature $T_{NOM}$ (25° C. in the exemplary embodiment) by a straight line tangent to the respective temperature sensitivity curve segment at $T_{NOM}$ plus an increasing deviation from the straight line as temperatures move away from $T_{NOM}$, which deviation can be reasonably well approximated by a square law deviation. Further, the general shape of the deviation curves are quite well defined for the type of device illustrated, as will be the case for many different devices. Consequently, the use of a square law correction as well as the linear correction already described can further greatly reduce the residual temperature sensitivity.

Figure 8:
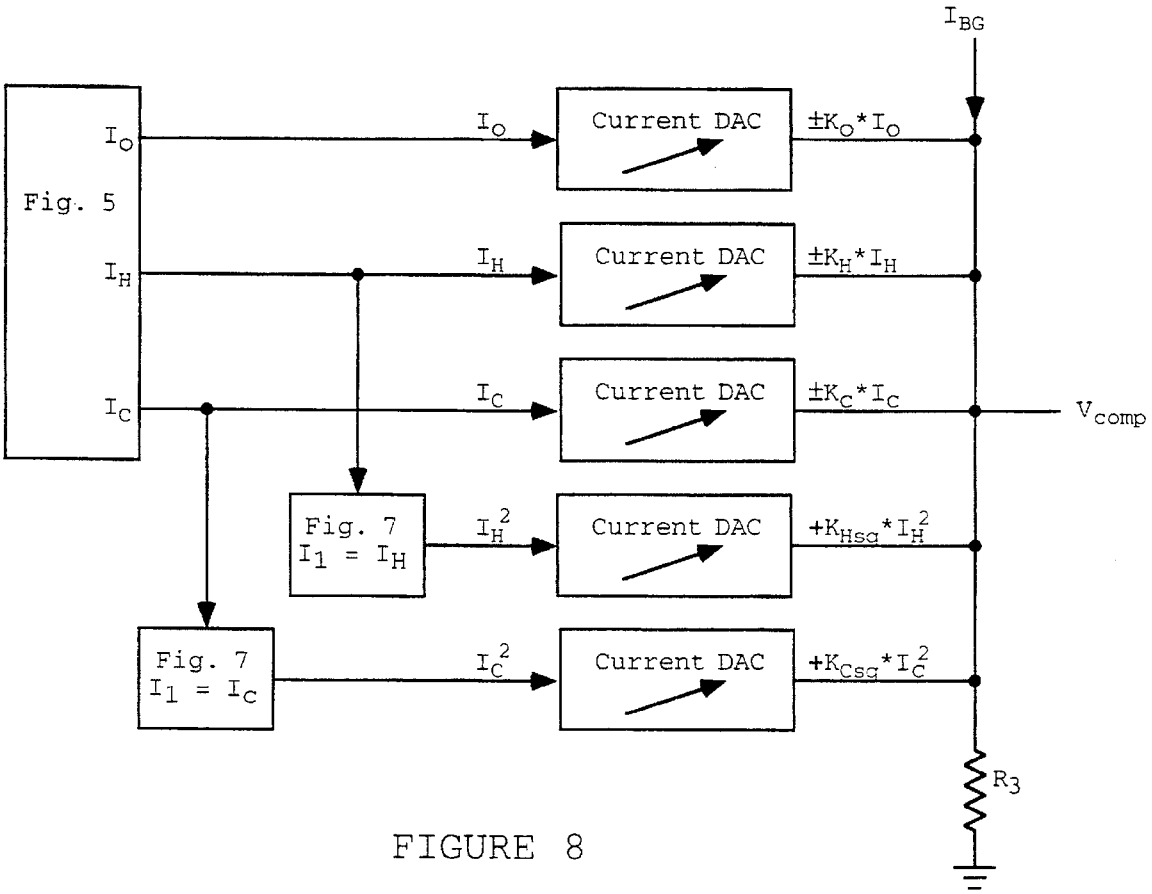
FIG. 8 is a block diagram illustrating five programmable current DACs and associated circuitry to generate the error corrections based on $I_o$, $I_H$, $I_C$, $I_H^2$ and $I_C^2$.

By way of specific example, consider FIG. 8. Here, corrections to the output of the bandgap reference are shown being made for $I_O$, $I_H$, $I_C$, $I_H^2$ and $I_C^2$. The corrections for $I_H^2$ and $I_C^2$ are shown as always being positive corrections only, as the concave downward shape of the curve of FIGS. 1 and 3 will always require a positive square law component correction of the temperature sensitivity curve segments or FIGS. 2 and 4 from a tangent to the respective curve segments at $T_{NOM}$. Further, the temperature sensitivity curve shape is sufficiently predictable that the square law correction may be made at wafer sort by trimming the same to provide a predetermined amount of square law correction for each temperature sensitivity curve segment. Then after packaging, the linear temperature compensation would be adjusted as described to take out the linear components of temperature sensitivity, and to the first order, take out the error between the predetermined amount of square law correction used and the actual amount of square law correction that would have been ideal for that specific integrated circuit.

Figure 9:
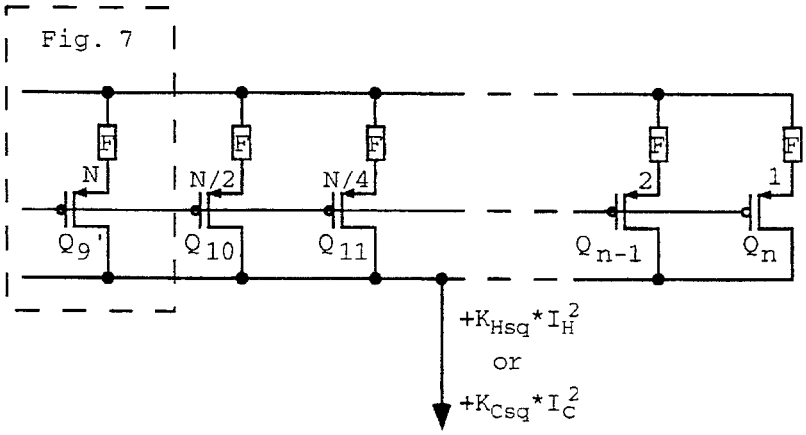
FIG. 9 is a circuit diagram of an exemplary square law DAC for trimming at wafer sort.

Since the square law DACs in this embodiment are to be trimmed at wafer sort, they can be of the general type illustrated in FIG. 9. Here a series of p-channel devices $Q_{9'}$ and $Q_{10}$ through $Q_N$ are shown, $Q_{9'}$ being connected to the circuit of FIG. 7 as shown for, and in place of, $Q_9$ of FIG. 7. Devices $Q_{9'}$ and $Q_{10}$ through $Q_N$ are each connected with their gates in common and their sources connected to $V_{DD}$ through a respective fuse link F comprising a thin film metal link. The devices $Q_{9'}$ and $Q_{10}$ through $Q_N$ are sized in a binary progression, so that selectively opening the fuse links by laser provides the desired adjustment of the respective square law current to provide $+K_{Hsq}*I_H^2$. The circuits of FIGS. 7 and 9 would of course be replicated once to provide $+K_{Csq}*I_C^2$ by using $I_1=I_C$ in the replication of FIG. 7 to provide $I_C^2$ as the input to the circuit of FIG. 9.

There are various ways of providing the temperature compensation information to each DAC. One approach, which requires three pins, is to use an up/down counter to drive the binary sequence of compensation components in the DACs. A pin is then needed for the clock, a tri-state pin to select one of the three DACs, and a tri-state pin for down/up/blow. Using this approach, one need not know scaling factors, but can instead just count up or down until $V_{OUT=VNOM}$ and then blow the programming fuses for that DAC.

As an alternate to the above, a shift register could be incorporated in the integrated circuit. By way of example, an 8 bit shift register together with a clock signal could be used to shift in an 8 bit code, 5 bits providing the five bit binary magnitude of the correction desired, one bit indicating the sign of the correction and two bits indicating the applicable correction—hot, cold or temperature insensitive, the fourth indicting no DAC at all. This too avoids a need to calibrate the scale factors of the corrections at wafer sort, as a first loading of the shift register can be made after packaging using an approximate scale factor for the correction, and upon measuring the real effect of the first correction attempt, the scale factor is in essence known, so that the second or third loading should be right on, after which the data contents of the shift register can be frozen.

Figure 10:
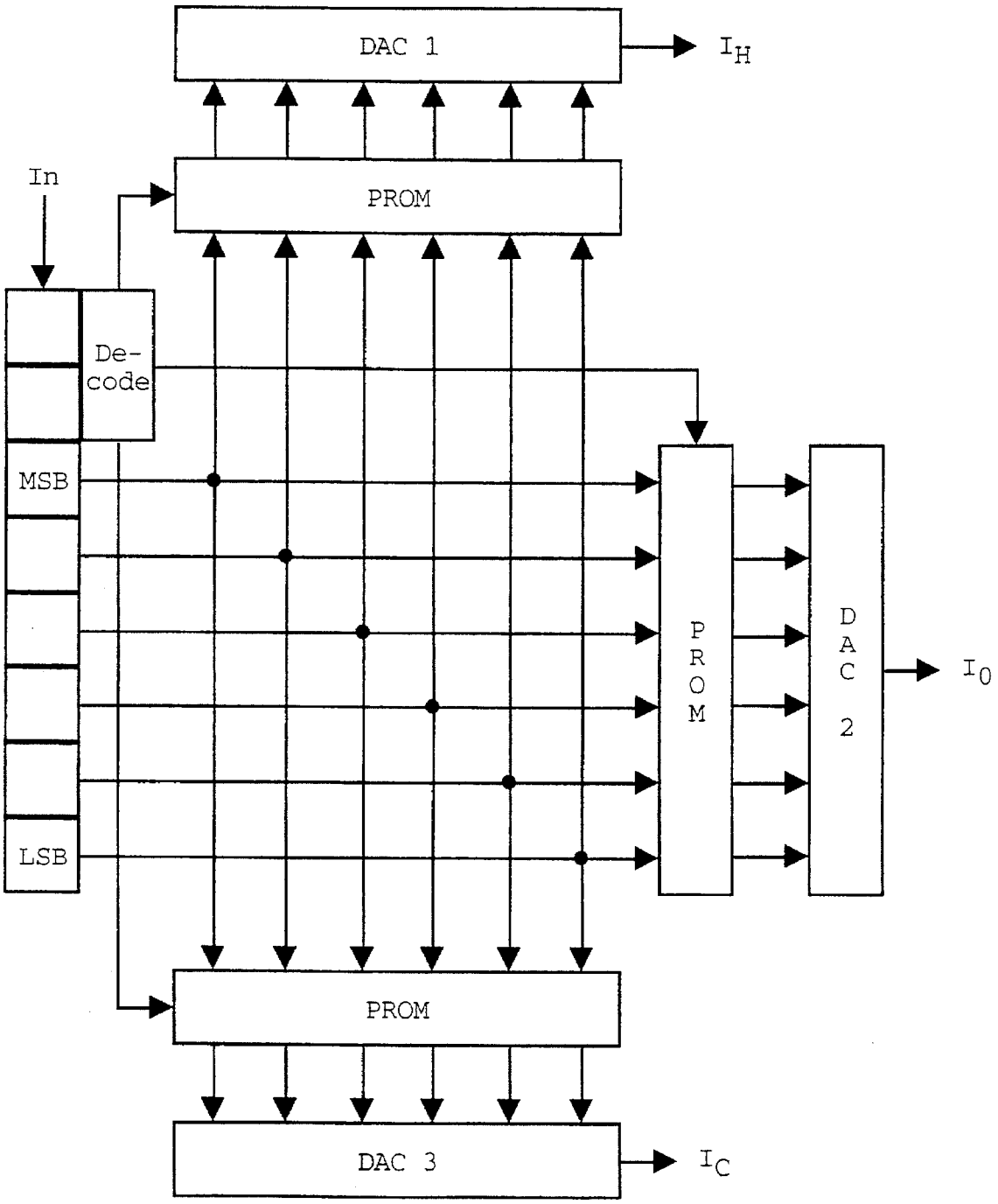
FIG. 10 is a block diagram illustrating the shift register 30 and the PROMs and DACs controlled by the output of the shift register.
Figure 11:
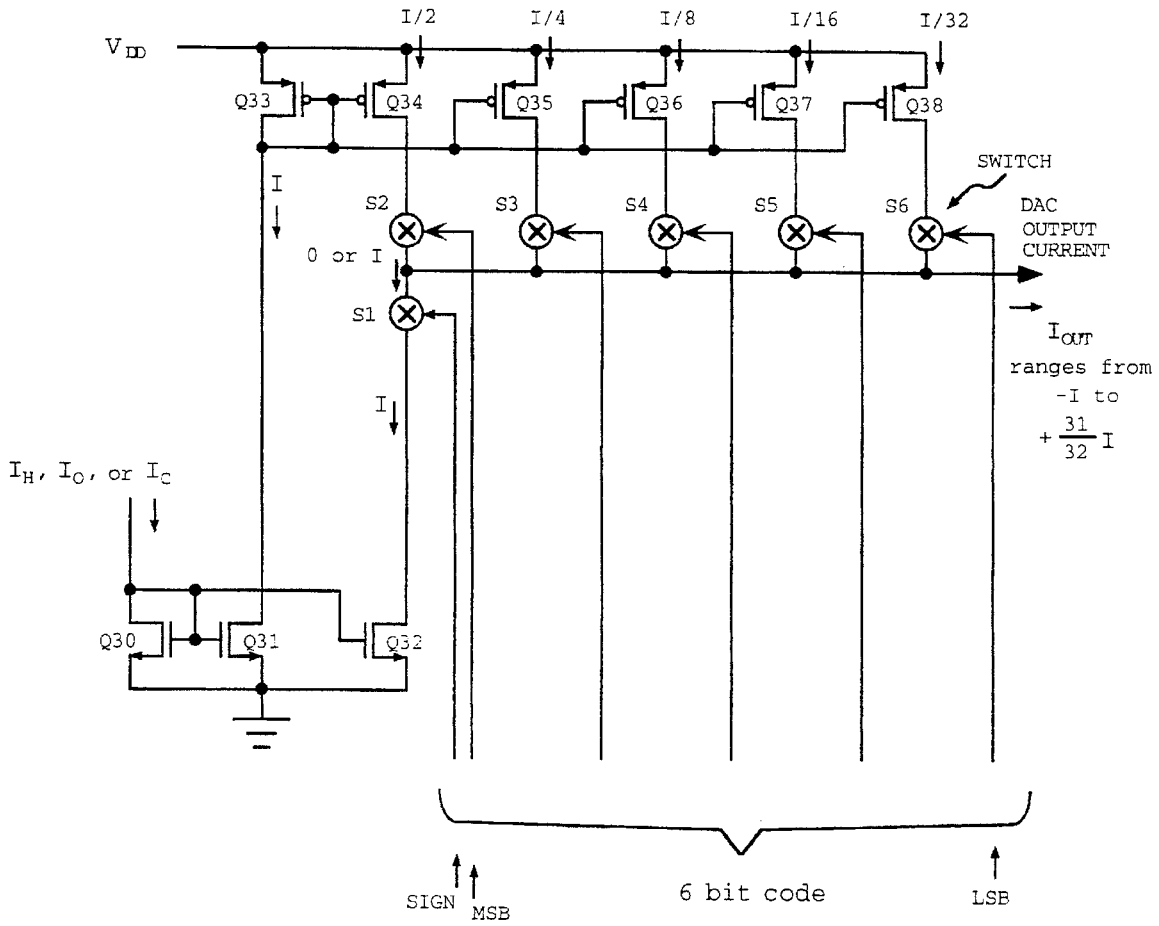
FIG. 11 is a circuit diagram for a typical DAC of FIG. 10.

The foregoing is illustrated in FIGS. 10 and 11, FIG. 10 showing shift register 30 and FIG. 11 showing one DAC controlled thereby. As shown in FIG. 10, shift register 30 receives the 8 bit code, outputting six bits thereof to programmable ROMs (PROMs), one for each of DAC 1, DAC 2 or DAC 3, depending on the decoding of the remaining 2 bits by decoder 32. The PROMs temporarily hold an output of the shift register coupled to them, but can permanently retain their contents upon a programming signal to blow the fuses therein (or set whatever other permanent programming device is used). FIG. 10 specifically illustrates $I_0$, $I_H$ and $I_C$, though the circuit is of course equally useful with other temperature dependencies.

As shown in FIG. 11, a typical DAC is comprised of n-channel transistors Q30, Q31 and Q32, and p-channel transistors Q33 through Q38. The input current to the DAC, $I_0$, $I_H$ or $I_C$, is mirrored by transistor Q30 to transistors Q31 and Q32, with the current in transistor Q31 being in turn mirrored to transistors Q33 through Q38. Transistors Q34 through Q38, however, are sized in a binary progression. Thus the current I in transistor Q31 is mirrored to transistor Q33 to set the gate-source voltage for all of transistors Q33 through Q38. Transistor Q34, being half the size of transistor Q33, therefore provides a current source for the current I/2. Transistor Q35, being one-half the size of transistor Q34, provides a current source I/4, etc. These current sources may be individually selected or disconnected from the DAC output current $I_{OUT}$ by control of individual switches S2 through S6. Thus, if all switches S2 through S6 are on, the DAC output current will be 31/32 I. If, on the other hand switch S1, controlled by the sign bit, is on, a current I is sinked from the DAC output current. Now, if all of switches S2 through S6 are off, a total current sinking equal to I is provided. At the other extreme, if all of switches S2 through S6 are on when switch S1 is on, the net current sinking from the DAC output current will be I minus the total current sourcing through switches S2 through S6 of 31/32 I, giving a net sinking of I/32. A zero DAC output current is provided by having all switches S1 through S6 open.

In some instances, extra pins may be required on the integrated circuit as packaged. In other instances, however, adequate numbers of pins may already exist, some or all of which may be adapted for dual function (as is well known in the prior art), at least until the fuses are blown. By way of specific example, in a conventional digital to analog converter having an onboard voltage reference and pins to receive a parallel input signal, the parallel input pins, or at least some of them, could be adapted for dual function so that the digital correction word for each DAC may be input in parallel. Here too, scaling factors for the correction would not need to be known.

It was previously mentioned that if further piece-wise linear compensation was desired, one or more additional compensating current components may be generated based on other "nominal" temperatures. This has the disadvantage that trimming at the other nominal temperatures at the time of wafer sort would be needed. If the temperature sensitivity of the device to be compensated has a relatively smooth curving characteristic, and preferably free of inflection points in the temperature range of interest, then adjustment of multiple compensation components can be made at multiple temperatures after packaging with trimming at wafer sort being done only at one temperature. For instance consider the compensation components of FIG. 8, but in a system wherein all DACs can be adjusted after packaging. In this system one might use a longer shift register so that all DACs could be altered at any time prior to burn in of the desired correction code. Here one would trim at wafer sort at one temperature, namely so that $I_H$ and $I_C=0$ ($=I_H^2=I_C^2$) at $T_{NOM}$. Then after packaging, measurements could be taken at five temperatures across the temperature range, such as at $T_{NOM}$, two different temperatures above $T_{NOM}$ and two different temperatures below $T_{NOM}$ to determine the corrections needed at all five temperatures and to determine the scale factors of each correction component. Now a simple calculation can be made to determine the correction code to set all five correction components to compensate the reference output at all five temperatures, after which the code can be permanently set.

The foregoing has advantages over the use of piecewise linear compensation components adjusted at five temperatures in that not only is trimming at wafer sort needed only at one temperature, but both first and second order corrections are made above and below $T_{NOM}$. For many systems, a much higher degree of compensation might be achieved this way than a corresponding multiple piecewise linear correction system will provide. Also of course, while correction components of linear and square law characteristics have been described in detail herein, both above and below $T_{NOM}$, other temperature dependencies can readily be generated and used, such as $(T-T_{NOM})^{0.5}$, $(T-T_{NOM})^{1.5}$, $(T-T_{NOM})^3$, etc. as best compensates the characteristic temperature dependence of the respective temperature range segment of the reference being compensated.

The present invention has been described herein with respect to preferred embodiments as applied to voltage references. Clearly, however, the application of the present invention is not exclusively limited to such references, but may be used for compensation of other references as desired. By way of example, obviously current references could be compensated by merely using the current components like those generated by the preferred embodiments described herein. Also, another exemplary type of reference which may be compensated by the methods and apparatus of the present invention are frequency references, as such references generally have or can be made to have a circuit parameter which can be affected by a compensating current or voltage as desired. For instance, Maxim Integrated Products, Inc. produces a frequency reference operative on a saw tooth type current waveform, wherein the frequency would be readily compensatable by injecting compensating current components into that waveform. Further, making the compensation permanent or semi-permanent may be done by other than blowing fuses or fuse links, such as by way of example, by using well known floating gate programmable cell technology, though whatever technology is used should preferably be fully compatible with the fabrication technology of the reference itself so as to avoid the necessity of extra fabrication steps to incorporate the present invention.

Finally, while compensating current components, and/or voltage components which may be generated by passing the compensating current components through a resistor, have been described herein and are believed to be the easiest parameters to generate for temperature compensation purposes, other electrical parameters might also be considered, depending upon the specific application of the present invention. Thus, while the present invention has been disclosed and described with respect to certain preferred embodiments thereof, it will be understood by those skilled in the art that the present invention may be altered in various ways and realized in various other embodiments without departing from the spirit and scope thereof.

I claim:

1. A method of temperature compensating the output of a reference circuit to better achieve the desired output of the reference circuit over temperature comprising the steps of:

a) generating a first electrical parameter having a value which is substantially independent of temperature;

b) generating a second electrical parameter having a value which has a substantially constant value below a first reference temperature and which has a value which varies with temperature in a predetermined manner at temperatures above the first reference temperature, the first and second electrical parameters being generated by an integrated circuit on the same integrated circuit substrate as at least part of the reference circuit;

c) adjusting the output of the reference circuit when at the first reference temperature to obtain a desired output of the reference circuit at that temperature by applying a weighted portion of the first electrical parameter to the reference circuit; and d) adjusting the output of the reference circuit when at a second temperature substantially above the first reference temperature to obtain a desired output of the reference circuit at that temperature by applying a weighted portion of the second electrical parameter to the reference circuit.

2. The method of claim 1 wherein the second electrical parameter is substantially zero below the first reference temperature and has a value which varies approximately linearly with temperature at temperatures above the first reference temperature.

3. The method of claim 2 wherein the first and second electrical parameters are currents.

4. The method of claim 2 wherein the first and second electrical parameters are voltages.

5. The method of claim 1 wherein step b) comprises the step of generating first and second components of the second electrical parameter, the first component having a value which has a substantially constant value below a first reference temperature and which has a value which varies with temperature in a first predetermined manner at temperatures above the first reference temperature, and the second component having a value which has a substantially constant value below a first reference temperature and which has a value which varies with temperature in the first predetermined manner but in an opposite direction at temperatures above the first reference temperature, and in step d), the output of the reference circuit is adjusted when at a temperature substantially above the first reference temperature by applying a weighted portion of one of the two components of the second electrical parameter to the reference circuit.

6. The method of claim 1 wherein steps c) and d) are done after packaging the integrated circuit.

7. The method of claim 1 further comprised of the steps of:

e) generating a third electrical parameter having a value which has a substantially constant value below the second temperature and which has a value which varies with temperature in a predetermined manner at temperatures above the second temperature, the first, second and third electrical parameters being generated by an integrated circuit on the same integrated circuit substrate as at least part of the reference circuit; and f) adjusting the output of the reference circuit when at a third temperature substantially above the second temperature to obtain the desired output of the reference circuit at the third temperature by applying a weighted portion of the third electrical parameter to the reference circuit.

8. A method of temperature compensating the output of a reference circuit to better achieve the desired output of the reference circuit over temperature comprising the steps of:

a) generating a first electrical parameter having a value which is substantially independent of temperature;

b) generating a second electrical parameter having a value which has a substantially constant value above a first reference temperature and which has a value which varies with temperature in a predetermined manner at temperatures below the first reference temperature, the first and second electrical parameters being generated by an integrated circuit on the same integrated circuit substrate as at least part of the reference circuit;

c) adjusting the output of the reference circuit when at the first reference temperature to obtain a desired output of the reference circuit at that temperature by applying a weighted portion of the first electrical parameter to the reference circuit; and d) adjusting the output of the reference circuit when at a second temperature substantially below the first reference temperature to obtain a desired output of the reference circuit at that temperature by applying a weighted portion of the second electrical parameter to the reference circuit.

9. The method of claim 8 wherein the second electrical parameter is substantially zero above the first reference temperature and has a value which varies approximately linearly with temperature at temperatures below the first reference temperature.

10. The method of claim 9 wherein the first and second electrical parameters are currents.

11. The method of claim 9 wherein the first and second electrical parameters are voltages.

12. The method of claim 8 wherein step b) comprises the step of generating first and second components of the second electrical parameter, the first component having a value which has a substantially constant value above a first reference temperature and which has a value which varies with temperature in a first predetermined manner at temperatures below the first reference temperature, and the second component having a value which has a substantially constant value above a first reference temperature and which has a value which varies with temperature in the first predetermined manner but in an opposite direction at temperatures below the first reference temperature, and in step d), the output of the reference circuit is adjusted when at a temperature substantially below the first reference temperature by applying a weighted portion of one of the two components of the second electrical parameter to the reference circuit.

13. The method of claim 8 wherein steps c) and d) are done after packaging the integrated circuit.

14. The method of claim 8 further comprised of the steps of:

e) generating a third electrical parameter having a value which has a substantially constant value above the second temperature and which has a value which varies with temperature in a predetermined manner at temperatures below the second temperature, the first, second and third electrical parameters being generated by an integrated circuit on the same integrated circuit substrate as at least part of the reference circuit; and f) adjusting the output of the reference circuit when at a third temperature substantially below the second temperature to obtain the desired output of the reference circuit at the third temperature by applying a weighted portion of the third electrical parameter to the reference circuit.

15. A method of temperature compensating the output of a reference circuit to better achieve the desired output of the reference circuit over temperature comprising the steps of:

a) generating a first electrical parameter having a value which is substantially independent of temperature;

b) generating a second electrical parameter having a value which has a substantially constant value below a first reference temperature and which has a value which varies with temperature in a predetermined manner at temperatures above the first reference temperature;

c) generating a third electrical parameter having a value which has a substantially constant value above a first reference temperature and which has a value which varies with temperature in a predetermined manner at temperatures below the first reference temperature, the first, second and third electrical parameters being generated by an integrated circuit on the same integrated circuit substrate as at least part of the reference circuit;

d) adjusting the output of the reference circuit when at the first reference temperature to obtain a desired output of the reference circuit at that temperature by applying a weighted portion of the first electrical parameter to the reference circuit;

e) adjusting the output of the reference circuit when at a second temperature substantially above the first reference temperature to obtain a desired output of the reference circuit at that temperature by applying a weighted portion of the second electrical parameter to the reference circuit; and f) adjusting the output of the reference circuit when at a third temperature substantially below the first reference temperature to obtain a desired output of the reference circuit at that temperature by applying a weighted portion of the third electrical parameter to the reference circuit.

16. The method of claim 15 wherein the second electrical parameter is substantially zero at temperatures below the first reference temperature and the third electrical parameter is 4 substantially zero at temperatures above the first reference temperature.

17. The method of claim 16 wherein the electrical parameters are currents.

18. The method of claim 16 wherein the electrical parameters are voltages.

19. A method of temperature compensating the output of a reference circuit realized at least in part in integrated circuit form to better achieve the desired output of the reference circuit over temperature comprising the steps of:

providing temperature compensation circuitry:

for generating a first electrical parameter having a value which is substantially independent of temperature;

for generating a second electrical parameter having a value which has a substantially constant value below a first temperature and which has a value which varies with temperature in a predetermined manner at temperatures above the first temperature;

for generating a third electrical parameter having a value which has a substantially constant value above a second temperature and which has a value which varies with temperature in a predetermined manner at temperatures below the second temperature;

the compensation circuitry being on the same integrated circuit substrate as at least part of the reference circuit;

adjusting at the time of wafer sort, the second and third electrical parameters so that the first and second temperatures defining the characteristics of the second and third electrical parameters are both a predetermined reference temperature;

adjusting after packaging the integrated circuit:

the output of the reference circuit when at the reference temperature to obtain a desired output of the reference circuit at that temperature by applying a weighted portion of the first electrical parameter to the reference circuit;

adjusting the output of the reference circuit when at a third temperature substantially above the reference temperature to obtain a desired output of the reference circuit at that temperature by applying a weighted portion of the second electrical parameter to the reference circuit; and adjusting the output of the reference circuit when at a fourth temperature substantially below the reference temperature to obtain a desired output of the reference circuit at that temperature by applying a weighted portion of the third electrical parameter to the reference circuit.

20. The method of claim 19 wherein at wafer sort, the second and third electrical parameters are adjusted so that the second electrical parameter is substantially zero at temperatures below the reference temperature and the third electrical parameter is substantially zero at temperatures above the first reference temperature.

21. The method of claim 19 wherein the electrical parameters are currents.

22. The method of claim 19 wherein the electrical parameters are voltages.

23. A method of temperature compensating the output of a reference circuit realized at least in part in integrated circuit form to better achieve the desired output of the reference circuit over temperature comprising the steps of:

providing temperature compensation circuitry:

for generating a first electrical parameter having a value which is substantially independent of temperature;

for generating a second electrical parameter having a value which has a substantially constant value below a first temperature and which has a value which varies with temperature in a first predetermined manner at temperatures above the first temperature;

for generating a third electrical parameter having a value which has a substantially constant value above a second temperature and which has a value which varies with temperature in a second predetermined manner at temperatures below the second temperature;

for generating a fourth electrical parameter having a value which has a substantially constant value below a third temperature and which has a value which varies with temperature in a third predetermined manner at temperatures above the third temperature;

for generating a fifth electrical parameter having a value which has a substantially constant value above a fourth temperature and which has a value which varies with temperature in a fourth predetermined manner at temperatures below the fourth temperature;

the compensation circuitry being on the same integrated circuit substrate as at least part of the reference circuit;

adjusting at the time of wafer sort, the second, third, fourth and fifth electrical parameters so that the first, second, third and fourth temperatures defining the characteristics of the second, third, fourth and fifth electrical parameters are all a predetermined reference temperature, and applying a predetermined amount of the fourth and fifth electrical parameters to the output of the reference circuit;

adjusting after packaging the integrated circuit:

the output of the reference circuit when at the reference temperature to obtain a desired output of the reference circuit at that temperature by applying a weighted portion of the first electrical parameter to the reference circuit;

adjusting the output of the reference circuit when at a third temperature substantially above the reference temperature to obtain a desired output of the reference circuit at that temperature by applying a weighted portion of the second electrical parameter to the reference circuit; and adjusting the output of the reference circuit when at a fourth temperature substantially below the reference temperature to obtain a desired output of the reference circuit at that temperature by applying a weighted portion of the third electrical parameter to the reference circuit.

24. The method of claim 23 wherein at wafer sort, the second, third, fourth and fifth electrical parameters are adjusted so that the second and fourth electrical parameters are substantially zero at temperatures below the reference temperature and the third and fifth electrical parameters are substantially zero at temperatures above the first reference temperature.

25. The method of claim 23 wherein the fourth electrical parameter is generated from the second electrical parameter and the fifth electrical parameter is generated from the third electrical parameter.

26. The method of claim 23 wherein the electrical parameters are currents.

27. The method of claim 23 wherein the electrical parameters are voltages.

28. A method of temperature compensating the output of a reference circuit realized at least in part in integrated circuit form to better achieve the desired output of the reference circuit over temperature comprising the steps of:

providing temperature compensation circuitry:

for generating a first electrical parameter having a value which is substantially independent of temperature;

for generating a second electrical parameter having a value which has a substantially constant value below a first temperature and which has a value which varies with temperature in a first predetermined manner at temperatures above the first temperature;

for generating a third electrical parameter having a value which has a substantially constant value above a second temperature and which has a value which varies with temperature in a second predetermined manner at temperatures below the second temperature;

for generating a fourth electrical parameter having a value which has a substantially constant value below a third temperature and which has a value which varies with temperature in a third predetermined manner at temperatures above the third temperature;

for generating a fifth electrical parameter having a value which has a substantially constant value above a fourth temperature and which has a value which varies with temperature in a fourth predetermined manner at temperatures below the fourth temperature;

the compensation circuitry being on the same integrated circuit substrate as at least part of the reference circuit;

adjusting at the time of wafer sort, the second, third, fourth and fifth electrical parameters so that the first, second, third and fourth temperatures defining the characteristics of the second, third, fourth and fifth electrical parameters are all a predetermined reference temperature;

determining after packaging the integrated circuit, the compensation the reference circuit needs at the reference temperature, at two different temperatures above the reference temperature and at two different temperatures below the reference temperature; and applying weighted portions of the first, second, third, fourth and fifth electrical parameters to the reference circuit to obtain desired outputs of the reference circuit at all five temperatures.

29. The method of claim 28 wherein at wafer sort, the second, third, fourth and fifth electrical parameters are adjusted so that the second and fourth electrical parameters are substantially zero at temperatures below the reference temperature and the third and fifth electrical parameters are substantially zero at temperatures above the first reference temperature.

30. The method of claim 28 wherein the fourth electrical parameter is generated from the second electrical parameter and the fifth electrical parameter is generated from the third electrical parameter.

31. The method of claim 28 wherein the electrical parameters are currents.

32. The method of claim 28 wherein the electrical parameters are voltages.

* * * * *